US010109415B2

(12) United States Patent
Park et al.

(10) Patent No.: US 10,109,415 B2
(45) Date of Patent: Oct. 23, 2018

(54) WIRELESS POWER RECEIVER AND EXTERNAL INDUCTOR CONNECTED THERETO

(71) Applicant: Samsung Electronics Co., Ltd., Suwon-si (KR)

(72) Inventors: Jae-Hyun Park, Yongin-si (KR); Young-Ho Ryu, Yongin-si (KR); Do-Won Kim, Suwon-si (KR); Sang-Wook Kwon, Seongnam-si (KR); Dong-Zo Kim, Yongin-si (KR); Sung-Bum Park, Suwon-si (KR); Sung-Ku Yeo, Daejeon (KR)

(73) Assignee: Samsung Electronics Co., Ltd. (KR)

( * ) Notice: Subject to any disclaimer, the term of this patent is extended or adjusted under 35 U.S.C. 154(b) by 158 days.

(21) Appl. No.: 14/990,503

(22) Filed: Jan. 7, 2016

(65) Prior Publication Data

US 2016/0197491 A1 Jul. 7, 2016

(30) Foreign Application Priority Data

Jan. 7, 2015 (KR) ..... 10-2015-0002004
Jan. 6, 2016 (KR) ..... 10-2016-0001448

(51) Int. Cl.
*H01F 27/42* (2006.01)
*H01F 38/14* (2006.01)

(52) U.S. Cl.
CPC ..... *H01F 38/14* (2013.01)

(58) Field of Classification Search
CPC ..... H02J 7/025; H02J 5/005; H02J 17/00
See application file for complete search history.

(56) References Cited

U.S. PATENT DOCUMENTS 5,337,063 A 8/1994 Takahira
8,805,456 B1 * 8/2014 Hardy ..... H02J 7/025 455/41.1
9,564,678 B2 * 2/2017 Kato ..... H01Q 1/38
2007/0103248 A1 * 5/2007 Nakamura ..... H03D 3/007 331/167
2007/0222542 A1 9/2007 Joannopoulos et al.
2013/0093388 A1 4/2013 Partovi
2013/0249302 A1 * 9/2013 An ..... H01F 41/14 307/104

(Continued)

FOREIGN PATENT DOCUMENTS

EP 2613329 A1 7/2013
EP 2645385 A2 10/2013

(Continued)

OTHER PUBLICATIONS

Int'l Search Report for PCT/KR2016/000120 dated May 13, 2016.

(Continued)

*Primary Examiner* — Sibin Chen
(74) *Attorney, Agent, or Firm* — McAndrews, Held & Malloy, Ltd.

(57) ABSTRACT

Disclosed is an external inductor that is connected to a wireless power receiver. The external inductor may include a conductor including at least one main slit, a first connecting unit that connects a first point of the conductor and the wireless power receiver with each other, and a second connecting unit that connects a second point of the conductor and the wireless power receiver with each other.

18 Claims, 15 Drawing Sheets

(56) References Cited

U.S. PATENT DOCUMENTS

| | | | | |
|---|---|---|---|---|
| 2014/0176288 | A1 | 6/2014 | Jung et al. | |
| 2015/0137742 | A1* | 5/2015 | Tseng | H02J 7/025 320/108 |

FOREIGN PATENT DOCUMENTS

| | | | |
|---|---|---|---|
| KR | 101258088 | | 4/2013 |
| KR | 10-2014-0083450 | A | 7/2014 |
| KR | 10-2014-0143104 | A | 12/2014 |

OTHER PUBLICATIONS

Written Opinion for PCT/KR2016/000120 dated May 13, 2016.
Extended European Search Report for Appln. No. 16735175.8 dated Dec. 8, 2017.

* cited by examiner

WIRELESS POWER RECEIVER AND EXTERNAL INDUCTOR CONNECTED THERETO

RELATED APPLICATION(S)

This application claims the priority under 35 U.S.C. § 119(a) to Korean Application Serial No. 10-2015-0002004, which was filed in the Korean Intellectual Property Office on Jan. 7, 2015, and to Korean Application Serial No. 10-2016-0001448, which was filed in the Korean Intellectual Property Office on Jan. 6, 2016, the entire contents of which are hereby incorporated by reference.

BACKGROUND

The present disclosure relates to a wireless power receiver, and more particularly, to a wireless power receiver that receives power from a wireless power transmitter.

A mobile terminal, such as a portable phone or a PDA (Personal Digital Assistant), uses rechargeable battery. In order to charge such a battery, electric energy is supplied by a separate charging device that plugs into the mobile device, or otherwise mates the contact terminals of the mobile device to contact terminals of the charging device. However, this type of charging method exposes the contact terminals on the mobile device and/or the charging device to the environment. Accordingly, the contact terminals may get contaminated by foreign matter, thereby interfering with charging the battery. Additionally, the exposed contact terminals on the mobile device may make it harder to make the mobile device water resistant.

Wireless charging, or contactless charging, technology has been developed and used for a number of electronic devices. Such wireless charging technology uses wireless power transmission and reception. The wireless charging technology allows a battery to be charged by merely putting a mobile device, such as a cell phone, on a charging pad without connecting the portable phone to a separate charging device. Wireless charging technology is used for many devices currently, including for wireless electric toothbrushes and wireless electric shavers. It is expected that wireless charging technology will advance significantly as electric cars become more common.

Presently, wireless charging technology main interest is with the inductive coupling method, the resonance inductive coupling method, and the RF/microwave radiation method. When power is transferred by the inductive coupling method, referred to in this disclosure as the inductive method, current in a primary coil generates a magnetic field, and that magnetic field induces current in a secondary coil. Power transmission using inductive coupling has excellent energy transmission efficiency. However, the primary and secondary coils must be very close to each other for efficient energy transfer.

The resonance inductive coupling method, referred to in this disclosure as the resonance method, is a type of inductive coupling method where both the transmitter and the receiver have circuits tuned to a specific frequency. Professor Soljacic at MIT demonstrated this wireless charging system in 2005 by transferring power to an electronic device several meters away using Coupled Mode Theory. The resonance method uses the concept of resonance frequency, where resonance frequency is a characteristic of all objects. An object may preferentially generate or receive energy at its resonance frequency. For example, when a tuning fork is struck, it will vibrate at its resonance frequency. A wine glass near the turning fork with the same resonance frequency will absorb the acoustic energy of the vibrations generated by the tuning fork until the wine glass shatters. Similarly, a power transmitter using the resonance method generates a magnetic field of a specific frequency. Energy is transferred via that magnetic field only when there is a receiving device with receiving circuitry that has that resonance frequency. Due to larger distances between the transmitting device and the receiving device, the resonance method may have lower energy transmission efficiency than the inductive method.

The RF/microwave radiation method transmits RF/microwave signals that can be received and converted to electricity. This method has a lower energy transmission efficiency than the resonance method.

SUMMARY

A wireless power receiver may include an element for receiving wireless power from a wireless power transmitter. For example, in the case of both the resonance method and the inductive method, the wireless power receiver may include an inductor. As the inductor for receiving wireless power may be in the wireless power receiver, the wireless power receiver may have an increased size due to the size of the circuit board to accommodate the inductor and the thickness of the wireless power receiver may increase due to the size of the inductor. Additionally, when a metallic protective case is used for the wireless power receiver, the transfer efficiency of wireless power may be reduced because of the metal case.

According to various embodiments of the present disclosure, a wireless power receiver may include a conductor with a slit, a power processing unit configured to process received wireless power, a first connecting unit configured to connect a first point of the conductor to the power processing unit, and a second connecting unit configured to connect a second point of the conductor to the power processing unit. The wireless power receiver may further include an insulator disposed at least on a portion of the conductor and below the conductor. The insulator may also be disposed in the slit. The insulator may be formed from at least one of glass and plastic.

In various embodiments of the invention, the conductor is at least a part of a metal case for at least partially covering the wireless power receiver, and accordingly, the conductor may be detachable from the wireless power receiver. The conductor may also be configured with the power processing unit to generate induced current at a specific resonance frequency to receive the wireless power based on resonance method.

The power processing unit may include at least one capacitor, and the conductor and the one or more capacitors may form a resonance circuit having the specific resonance frequency. the power processing unit includes at least one capacitor, and the induced current may flow from the first point to the second point. The positions of the first connecting unit and the second connecting unit may be determined according to structure of the slit.

The power processing unit may include a first capacitor, where a first end of the first capacitor is connected to the first connecting unit and a second end of the first capacitor is connected to the second connecting unit. There may also be a second capacitor, where a first end of the second capacitor is connected to the first connecting unit and to the first end of the first capacitor, and also a third capacitor, where a first end of third capacitor is connected to the second connecting unit and to the second end of the first capacitor.

The conductor may also be configured with the power receiving unit to receive wireless power based on inductive method. The conductor may be configured to inductively couple with an inductor of a wireless power transmitter to generate an induced current in the conductor, and the induced current may flow from the first point to the second point.

According to various embodiments of the present disclosure, an external inductor may include a conductor including at least one main slit; a first connecting unit configured to connect a first point of the conductor to a wireless power receiver; and a second connecting unit configured to connect a second point of the conductor to the wireless power receiver. The power processing unit may include a first capacitor whose first end is connected to the first connecting unit, a second capacitor whose first end is connected to the second connecting unit, and a third capacitor whose first end is connected to a second end of the first capacitor, and a second end of the third capacitor is connected to a second end of the second capacitor.

The conductor may comprise a fastening unit configured to physically fasten the external inductor to the wireless power receiver.

The slit may comprise at least one slit and at least one auxiliary slit that is connected to the at least one slit. The auxiliary slit may be perpendicular to the at least one slit at a junction of the at least one slit and the auxiliary slit. The slit in the conductor may have a shape that causes a remaining portion of the conductor to be substantially in shape of a loop.

Various embodiments of the invention may include a first wiring connected to a first point of an external inductor, a second wiring connected to a second point of the external inductor, and a power reception unit configured to be connected to the external inductor to together receive wireless power via the first wiring and the second wiring According to this disclosure, various embodiments may provide an external inductor that is connected to a wireless power receiver. In addition, according to various embodiments of the present disclosure, a wireless power receiver may be connected to an external inductor to receive wireless power from a wireless power transmitter.

The external inductor may be configured with the wireless power receiver to generate induced current at a specific resonance frequency to receive wireless power based on resonance method. The induced current may flow from the first point to the second point.

The wireless power receiver may include at least one capacitor, and the external inductor and the at least one capacitor form a resonance circuit having the specific resonance frequency.

The wireless power receiver may include a first capacitor, where a first end of the first capacitor is connected to the first connecting unit and a second end of the first capacitor is connected to the second connecting unit; a second capacitor, where a first end of the second capacitor is connected to the first connecting unit and to the first end of the first capacitor; and a third capacitor, where a first end of third capacitor is connected to the second connecting unit and to the second end of the first capacitor.

The external inductor may be configured with the wireless power receiver to receive wireless power based on inductive method. The conductor may be configured to inductively couple with an inductor of a wireless power transmitter to generate induced current in the conductor. The induced current may flow from the first point to the second point.

The wireless power receiver may include a first capacitor, where a first end of the first capacitor is connected to the first connecting unit; a second capacitor, where a first end of the second capacitor is connected to the second connecting unit; and a third capacitor, where a first end of the third capacitor is connected to a second end of the first capacitor, and a second end of the third capacitor is connected to a second end of the second capacitor.

The external inductor may comprise a fastening unit configured to physically fasten the external inductor to the wireless power receiver and an insulation unit configured to insulate the external inductor from the wireless power receiver. The external inductor may also comprise at least one auxiliary slit that is connected to the main slit. The auxiliary slit may be perpendicular to the main slit where it joins the main slit.

The main slit in the conductor may have a shape that causes a remaining portion of the conductor to be substantially in the shape of a loop.

A wireless power receiver may comprise a first wiring connected to a first point of an external inductor; a second wiring connected to a second point of the external inductor; and a power reception unit configured to be connected to the external inductor to together receive wireless power via the first wiring and the second wiring.

The wireless power receiver may further comprise a rectifying unit configured to have as input the received wireless power and output rectified power and a DC/DC converter unit configured to convert voltage of the rectified power to a specified DC voltage.

The power reception unit and the external inductor may be configured to receive the wireless power at a specific resonance frequency based on resonance method.

The power reception unit may include a first capacitor, where a first end of the first capacitor is connected to the first point, and a second end of the first capacitor is connected to the second point; a second capacitor, where a first end of the second capacitor is connected to the first point and to the first end of the first capacitor; and a third capacitor, where a first end of the third capacitor is connected to the second point and to the second end of the first capacitor.

The power reception unit and the external inductor may be configured to receive the wireless power based on inductive method.

The wireless power receiver may comprise a first capacitor, where a first end of the first capacitor is connected to the first point; a second capacitor, where a first end of the second capacitor is connected to the second point; and a third capacitor, where a first end of the third capacitor is connected to a second end of the first capacitor, and a second end of the third capacitor is connected to a second end of the second capacitor.

An external power receiver may be connected to a wireless power receiver, where the external power receiver may comprise a conductor including at least one main slit; at least one capacitor connected with the conductor; and at least one connecting unit that electrically couples the external power receiver to the wireless power receiver, where the external power receiver is detachably mechanically fastened to the wireless power receiver.

The external power receiver may be configured to receive wireless power based on a resonance method, and the conductor and the at least one capacitor may form a resonance circuit having a specified resonance frequency. Induced current may flow from a first point of the conductor to a second point of the conductor when wireless power is received.

The at least one capacitor in the external power receiver may include a first capacitor, where a first end of the first capacitor is connected to the first point, and a second end of the first capacitor is connected to the second point; a second capacitor, where a first end of the second capacitor is connected to the first point and to the first end of the first capacitor; and a third capacitor, where a first end of the third capacitor is connected to the second point and to the second end of the first capacitor.

The conductor and the at least one capacitor of the external power receiver may be configured to receive wireless power based on an inductive method. The conductor may be configured to inductively couple with an inductor of a wireless power transmitter to generate induced current in the conductor, and the induced current may flow from a first point in the conductor to a second point in the conductor.

The at least one capacitor in the external power receiver may include a first capacitor, where a first end of the first capacitor is connected to the first point; a second capacitor, where a first end of the second capacitor is connected to the second point; and a third capacitor, where a first end of the third capacitor is connected to a second end of the first capacitor, and a second end of the third capacitor is connected to a second end of the second capacitor.

The external power receiver may comprise a fastening unit configured to detachably fasten the external power receiver mechanically to the wireless power receiver, and may also comprise an insulation unit that insulates the external power receiver from the wireless power receiver.

The conductor in the external power receiver may further include at least one auxiliary slit connected to the at least one main slit, and the auxiliary slit may be perpendicular to the main slit where it joins the main slit. The main slit in the conductor may have a shape that causes a remaining portion of the conductor to be substantially in the shape of a loop.

A wireless power receiver may comprise a power processing unit configured to process received wireless power, where the received wireless power is received via wiring from an external power receiver, and where the external power receiver is detachably mechanically coupled to the wireless power receiver. The power processing unit may further include a rectifying unit configured to rectify the received wireless power to output rectified power; and a DC/DC converter unit that converts the rectified power to DC power at a specific DC voltage.

An external inductor connected to a wireless power receiver may comprise an inductor; a first connecting unit that connects a first point of the inductor and the wireless power receiver with each other; and a second connecting unit that connects a second point of the inductor and the wireless power receiver with each other, where the wireless power receiver and the inductor may be configured to together receive wireless power.

An external power receiver connected to a wireless power receiver may comprise a receiving unit comprising an inductor and at least one capacitor connected with the inductor, wherein the receiving unit is configured to receive wireless power; and a connecting unit that transfers received wireless power to the wireless power receiver from the receiving unit, where the external power receiver is detachably mechanically fastened to the wireless power receiver.

According to various embodiments of the present disclosure, an external inductor, which is connected to a wireless power receiver, may include: a conductor including at least one main slit; a first connecting unit that connects a first point of the conductor and the wireless power receiver with each other; and a second connecting unit that connects a second point of the conductor and the wireless power receiver with each other.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
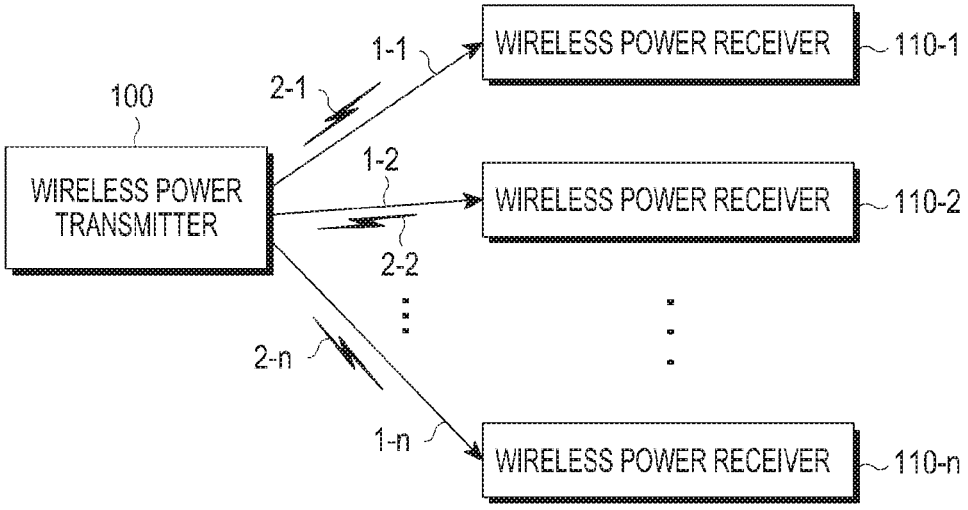
FIG. 1 is a conceptual view for describing overall operations of a wireless charging system that may be used with various embodiments of the disclosure.

Various embodiments of the present disclosure will be described with reference to the accompanying drawings. However, it should be understood that there is no intent to limit the present disclosure to the particular forms disclosed herein. Rather, the present disclosure should be construed to cover various modifications, equivalents, and/or alternatives of embodiments of the present disclosure. In describing the drawings similar reference numerals may be used to designate similar elements.

An expression such as "comprising," or "may comprise" may be used in the present disclosure to indicate existence of a corresponding function, operation, or component, and does not exclude existence of additional functions, operations, or components. In the present disclosure, the terms "comprising," "having," and "including" indicates a characteristic, a number, a step, a component, a part, a part, or a combination thereof, and should not be construed as excluding existence or a possibility of addition of one or more other characteristics, numbers, steps, operations, components, parts, or combinations thereof.

As used herein, the expression "at least one of A and/or B," or "one or more of A and/or B" may include any or all possible combinations of items enumerated together. For example, the expression "at least one of A and B," or "at least one of A or B" may include (1) at least one A, (2) at least one B, or (3) both at least one A and at least one B.

Expressions such as "first," "second," "primary," or "secondary" used in descriptions of various exemplary embodiments may represent various elements regardless of order and/or importance and do not necessarily indicate relative importance of or specific order of corresponding elements. The expressions may be used for distinguishing one element from another element. For example, a first user device and a second user device may represent different user devices without regard to order or importance. Accordingly, a first element may be referred to as a second element without deviating from the scope of the present disclosure, and similarly, a second element may be referred to as a first element.

When it is described that a first element is "operatively or communicatively coupled" or "connected" to a second element, the first element can be directly connected to the second element or it can be connected to the second element through a third element. However, when it is described that a first element is "directly connected" or "directly coupled" to a second element, it means that there is no intermediate element (such as a third element) between the first element and the second element.

The expression "configured to" used in the present disclosure may be replaced with, for example, "set to," "suitable for," "having the capacity to," "designed to," "adapted to," "made to," or "capable of" according to a situation. The expression "configured to" does not necessarily mean "specifically designed to" do a function by hardware. Alternatively, in some situation, an expression "apparatus configured to" may mean that the apparatus can operate together with another apparatus or component. For example, the phrase "a processor configured to perform A, B, and C" may refer to a generic-purpose processor (such as a CPU or an application processor) that can perform a corresponding operation by executing at least one software program stored at a memory device or an exclusive processor (such as an embedded processor) for performing a corresponding operation.

Terms defined in the present disclosure are used only for describing a specific exemplary embodiment and does not necessarily limit the scope of other exemplary embodiments. When used in the present disclosure and the appended claims, a singular form may also encompass the plural form unless it is explicitly stated otherwise. All terms including technical terms and scientific terms used here may have the same meaning as generally understood by a person of ordinary skill in the art. Terms defined in a dictionary have the same meaning as or a meaning similar to that of a context of related technology and should not be analyzed to have an ideal or excessively formal meaning unless explicitly defined as such. Terms defined in the present disclosure should not be analyzed to exclude the present exemplary embodiments.

A wireless power transmitter and/or a wireless power receiver, according to various embodiments of the present disclosure, may be included in various electronic devices. For example, the electronic device may include at least one of a smartphone, a tablet personal computer (tablet PC), a mobile phone, a video phone, an electronic book (e-book) reader, a desktop PC, a laptop PC, a netbook computer, a personal digital assistant (PDA), a portable multimedia player (PMP), an MP3 player, a mobile medical appliance, a camera, and a wearable device (e.g., a head-mounted-device (HMD) such as electronic glasses, electronic clothes, an electronic bracelet, an electronic necklace, an electronic appcessory, electronic tattoos, or a smart watch).

Referring to FIG. 1, a concept of a wireless charging system applicable for use in various embodiments of the present disclosure will be described.

FIG. 1 is a conceptual view for describing overall operations of a wireless charging system. As illustrated in FIG. 1, the wireless charging system includes a wireless power transmitter 100, and one or more wireless power receivers 110-1, 110-2, . . . , **110-*n***.

The wireless power transmitter 100 may transmit powers 1-1, 1-2, . . . , **1-*n* to the one or more wireless power receivers 110-1, 110-2, . . . , 110-*n*, respectively. More specifically, the wireless power transmitter 100 may transmit powers 1-1, 1-2, . . . , 1-*n* to those wireless power receivers 110-1, 110-2, . . . , 110-*n* that have been authenticated through a predetermined authentication procedure. The wireless power transmitter 100** may transmit wireless power based on, for example, the inductive method or the resonance method.

The wireless power transmitter 100 may conduct bidirectional communication with the wireless power receivers 110-1, 110-2, . . . , **110-*n*. The wireless power transmitter 100 and the wireless power receivers 110-1, 110-2, . . . , 110-*n* may use packets 2-1, 2-2, . . . , 2-*n***, respectively, for communication, where the packets may be configured as frames at lower network levels. The wireless power receiver may be, for example, a mobile terminal such as, for example, a PDA, a PMP, a smartphone, etc.

The wireless power transmitter 100 may provide power to the plurality of wireless power receivers 110-1, 110-2, . . . , **110-*n* in a wireless manner. For example, the wireless power transmitter 100 may transmit power to the plurality of wireless power receivers 110-1, 110-2, . . . , 110-*n* through the resonance method. When the wireless power transmitter 100 uses the resonance method, the distance between the wireless power transmitter 100 and the plurality of wireless power receivers 110-1, 110-2, . . . , 1110-*n* may be, for example, 30 m or less. When the wireless power transmitter 100 uses the inductive method, the distance between the wireless power transmitter 100 and the plurality of wireless power receivers 110-1, 110-2, . . . , 110-*n*** may be, for example, 10 cm or less.

Each of the wireless power receivers 110-1, 110-2, . . . , and **110-*n* may charge its associated battery by receiving the wireless power from the wireless power transmitter 100. In addition, each of the wireless power receivers 110-1**,

110-2, . . . , **110-*n* may transmit a signal for requesting wireless power transmission, information needed for receiving wireless power, wireless power receiver state information, wireless power transmitter 100 control information, or the like to the wireless power transmitter 100**.

In addition, each of the wireless power receiver 110-1, 110-2, . . . , and **110-*n* may transmit a message indicating the charge state of its associated battery to the wireless power transmitter 100**.

The wireless power transmitter 100 may include, for example, a display that can indicate the state of each of the wireless power receivers 110-1, 110-2, . . . , **110-*n* based on massages received from the wireless power receivers 110-1, 110-2, . . . , 110-*n*. The wireless power transmitter 100 may also be able to indicate an expected time until the charging of each of the wireless power receivers 110-1, 110-2, . . . , 110-*n*** is completed, as appropriate.

The wireless power transmitter 100 may also transmit control signals to each of the wireless power receivers 110-1, 110-2, . . . , **110-*n*** to disable its respective wireless charging function. A wireless power receiver that has received the control signal to disable its wireless charging function may then proceed to disable its wireless charging function.

Figure 2:
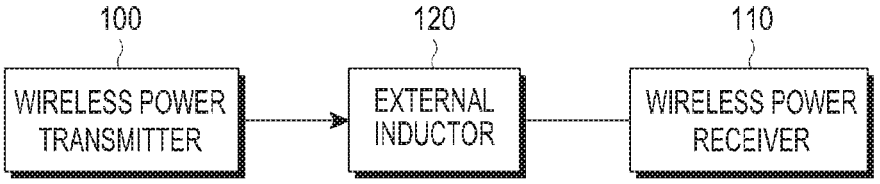
FIG. 2 is a block diagram illustrating a wireless power transmitter, an external inductor, and a wireless power receiver according to various embodiments of the present disclosure.

FIG. 2 is a block diagram illustrating a wireless power transmitter, an external inductor, and a wireless power receiver according to various embodiments of the present disclosure.

As illustrated in FIG. 2, according to various embodiments of the present disclosure, an external inductor 120 may be connected to a wireless power receiver 110. In various embodiments of the present disclosure, the external inductor 120 and the wireless power receiver 110 may be fabricated as different pieces of hardware. More specifically, the external inductor 120 may be detachably mechanically coupled to the wireless power receiver 110. For example, the external inductor 120 may include a fastening unit that allows the external inductor 120 to be fastened to the wireless power receiver 110. There may also be a counterpart fastening unit corresponding to the fastening unit of the external inductor 120 wireless power receiver 110 depending on implementation. When the fastening unit of the external inductor 120 and the counterpart fastening unit of the wireless power receiver 110 are coupled to each other, the external inductor 120 and the wireless power receiver 110 may be fastened to each other. In addition, when the fastening unit of the external inductor 120 and the counterpart fastening unit of the wireless power receiver 110 are separated from each other, the external inductor 120 and the wireless power receiver 110 may be separated from each other.

The external inductor 120 may be electrically connected to the wireless power receiver 110. The wireless power receiver 110 may include at least one wire capable of being connected with the external inductor 120. In this disclosure, the term "wire" may be used to generally refer to an area of conductive material or a conductive path such as, for example, trace on a PC board, a through via similar to those on a multi-layer PC board, or wire, etc. that may conduct electricity. The term "conductor" may be used to refer to similar things. The term "wiring" may be used for electrical paths connecting nodes and/or elements. In one embodiment, the wireless power receiver 110 may include a first wiring and a second wiring, and the first wiring may be connected to a first point of the external inductor 120. The second wiring may be connected to a second point of the external inductor 120. The external inductor 120 may include a first connecting unit that may connect the first point of the external inductor 120 to the first wiring. In addition, the external inductor 120 may include a second connecting unit that may connect the second point of the external inductor 120 to the second wiring. A point may also be referred to as a "node."

The external inductor 120 may receive the wireless power from the wireless power transmitter 100 together with the wireless power receiver 110. In one embodiment, the external inductor 120 and at least some elements of the wireless power receiver 110 may form a resonance circuit. Accordingly, the wireless power transmitter 100 may transfer power using the resonance method. The resonance circuit formed by the external inductor 120 and the wireless power receiver 110 may receive power wirelessly from the wireless power transmitter 100. The resonance frequency of the resonance circuit may have the same frequency as the received power. The power received by the resonance circuit may be processed by the wireless power receiver 110 to rectify and/or convert the wireless power to a desired voltage. The wireless power receiver 110 may store or output the processed wireless power.

In another embodiment, the external inductor 120 and the wireless power receiver 110 may receive wireless power from the wireless power transmitter 100 via the inductive method. The wireless power transmitter 100 may include an inductor. The inductor of the wireless power transmitter 100 may inductively couple with the external inductor. The inductor of the wireless power transmitter 100 may generate a magnetic field, which may induce current in the external inductor 120. The induced current may flow from the external inductor 120 to the wireless power receiver 110. Accordingly, power transferred wirelessly from the wireless power transmitter 100 to the external inductor 120 may be processed by the wireless power receiver 110. For example, the wireless power receiver 110 may rectify and/or may convert the wireless power to a desired voltage. The wireless power receiver 110 may store or output the processed power.

While it has been described that induced current flows from the external inductor 120 to the wireless power receiver 110 purely for ease of description, it is well understood in the art that the induced current described here is AC current, and, therefore, electrons flow from the external inductor 120 to the wireless power receiver 110 and vice versa as phase of the AC current changes. However, for ease of description, the induced current is said to flow from point A to point B in this disclosure.

The external inductor 120 may include a conductor that may have, for example, a main slit formed in the conductor. The main slit may be formed such that the remaining conductor portion, except for the main slit, may have a substantially loop shape. The conductor and the main slit will be described in more detail below. In still another embodiment, the external inductor 120 may include a loop-shaped conductor, which will also be described in more detail below.

According to the FIG. 2, the wireless power receiver 110 and the external inductor 120 may be implemented as different hardware. However, according to various embodiments of the present disclosure, the external inductor 120 may be detachable from the wireless power receiver 110, or the wireless power receiver 110 and the external inductor 120 may be implemented as one hardware. If the wireless power receiver 110 and the external inductor 120 are implemented as one hardware, the wireless power receiver 110 may include the external inductor 120, and "external" means external to the housing of the power receiver 110. The external inductor 120 may be implemented as part of a case of the wireless power receiver 110. The external inductor 120 may then have a structure for fastening to the wireless power receiver 110.

Since the external inductor 120 is a conductor, the external inductor 120 may be implemented as a metal case. In this case, the external inductor 120 may further comprise insulator for protecting user form the metal case. As discussed above, the external inductor 120 may be implemented as both independent hardware or hardware included in the wireless power receiver 110, and both implementations may be applied to all embodiments of the present disclosure.

Figure 3:
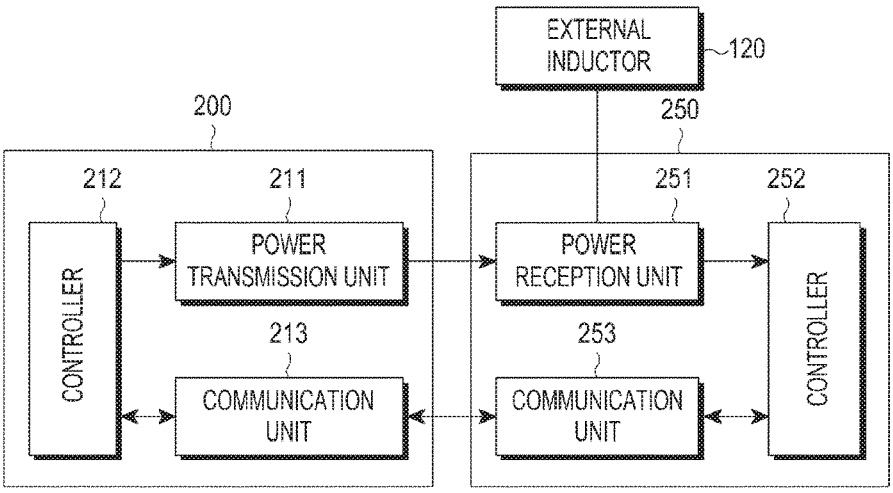
FIG. 3 is a block diagram of a wireless power transmitter and a wireless power receiver according to various embodiments of the present disclosure.

FIG. 3 is a block diagram of a wireless power transmitter and a wireless power receiver according to various embodiments of the present disclosure.

As illustrated in FIG. 3, the wireless power transmitter 200 may include a power transmission unit 211, a controller 212, and a communication unit 213. In addition, the wireless power receiver 250 may include a power reception unit 251, a controller 252, and a communication unit 253. Further, an external inductor 120 may be connected to the power reception unit 251.

The power transmission unit 211 may transfer power from the wireless power transmitter 200 to the wireless power receiver 250 and the external inductor 120. The power transmission unit 211 may include, for example, a resonance circuit or an induction circuit, and thus may transfer power via magnetic fields. When the power transmission unit 211 is implemented using the resonance method, the inductance L of the loop coil of the power transmission unit 211 may be variable. In addition, when the power transmission unit 211 is implemented using the inductive method, the power transmission unit 211 may be implemented with an inductor that may inductively couple with the external inductor 120.

The controller 212 may control the overall operations of the wireless power transmitter 200. The controller 212 may control the overall operations of the wireless power transmitter 200 using an algorithm, a program, or an application which is read from a storage unit (not illustrated). The controller 212 may be implemented in the form of a Central Processing Unit (CPU), a microprocessor, or a mini computer.

The communication unit 213 may communicate with the wireless power receiver 250 in a predetermined manner. The communication unit 213 may communicate with the communication unit 253 of the wireless power receiver 250 using, for example, NFC (Near Field Communication), Zigbee communication, infrared communication, visible ray communication, Bluetooth communication, BLE (Bluetooth Low Energy) method, or the like. The communication unit 213 may use, for example, Carrier Sense Multiple Access with Collision Avoidance (CSMA/CA) algorithm. The above-mentioned communication methods are merely illustrative, and various embodiments of the present disclosure are not limited to these specific communication methods.

The communication unit 213 may transmit a request for information from the wireless power receiver 250. The communication unit 213 may unicast, multicast, or broadcast the request as appropriate. The communication unit 213 may receive power information from the wireless power receiver 250. The power information may include information such as, for example, at least one of power capacity (e.g. in watts) of the wireless power receiver 250, remaining battery capacity, the number of times the battery has been charged, amount of battery capacity that has been used, battery capacity when fully charged, and battery ratio between the remaining battery capacity and the battery capacity when fully charged, and the like.

In addition, the communication unit 213 may transmit a charging function control signal for controlling the charging function of the wireless power receiver 250. The charging function control signal may be a control signal that controls the power reception unit 251 of the wireless power receiver 250 so as to enable or disable its charging function.

The communication unit 213 may receive communication not only from the wireless power receiver 250, but also from other wireless power transmitters (not illustrated). For example, the communication unit 213 may receive a signal from any other wireless power transmitter.

The controller 252 may control the overall operations of the wireless power receiver 250.

While FIG. 3 illustrates that the power transmission unit 211 and the communication unit 213 are configured so that the wireless power transmitter 200 uses out-of-band communication, various embodiments of the disclosure need not be so limited. The power transmission unit 211 and the communication unit 213 may implemented so that the wireless power transmitter 200 may use in-band communication.

The wireless power transmitter 200 and the wireless power receiver 250 may transmit/receive various signals, and thus a charging procedure may be performed through the joining of the wireless power receiver 250 to a wireless power network that is managed by the wireless power transmitter 200, and wireless power transmission/reception. The above-described procedure will be described in more detail below.

Figure 4:
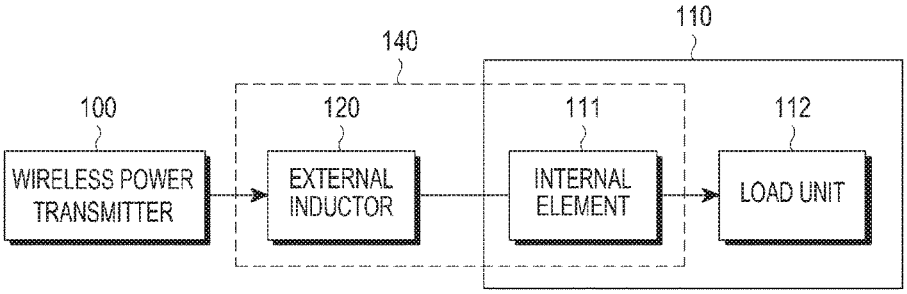
FIG. 4 illustrates a wireless power transmission/reception system by the resonance method according to various embodiments of the present disclosure.

FIG. 4 illustrates a wireless power transmission/reception system by a resonance method according to various embodiments of the present disclosure. As illustrated in FIG. 4, a wireless power receiver 110 may include at least one internal element 111 and a load unit 112. The internal element 111 may be referred to as a power reception unit. The internal element 111 may include, for example, at least one capacitor. The internal element 111 and the external inductor 120 may receive wireless power by forming a resonance circuit 140 with a specific resonance frequency that is the same frequency as the wireless power transmitted by the wireless power transmitter 100.

Figure 5:
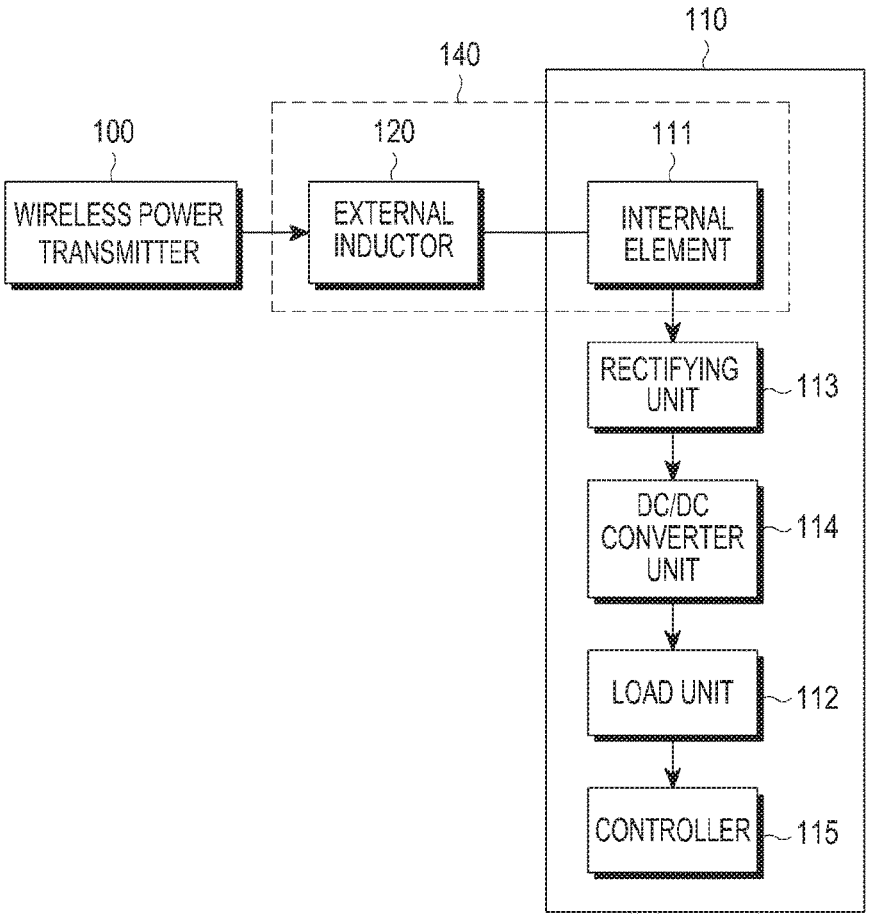
FIG. 5 illustrates wireless power transmission/reception system according to various embodiments of the present disclosure.

FIG. 5 illustrates a wireless power transmission/reception system according to various embodiments of the present disclosure. As illustrated in FIG. 5, the wireless power receiver 110 may further include a rectifying unit 113, a DC/DC converter unit 114, and a controller 115.

The rectifying unit 113 may rectify power from the resonance circuit 140 to DC. The rectifying unit 113 may be, for example, a diode bridge. The DC/DC converter unit 114 may convert the rectified power to a desired voltage. For example, the DC/DC converter unit 114 may convert the rectified power to 5V power. The DC/DC converter unit 114 may have a specific input voltage range for the power it can convert. The load unit 112 may store the converted power, which is input from the DC/DC converter unit 114. Alternatively, the load unit 112 may output the converted power.

The controller 115 may control the operation of various elements of the wireless power receiver 110. The controller 115 may be, for example, a PMIC (Power Management Integrated Chip), a processor, or the like. The processor may be one or more of a central processing unit (CPU), an application processor (AP), and a communication processor (CP). The processor may perform, for example, arithmetic operations and/or data processing related to the control and/or communication of various elements of the wireless power receiver 110.

Figure 6A:
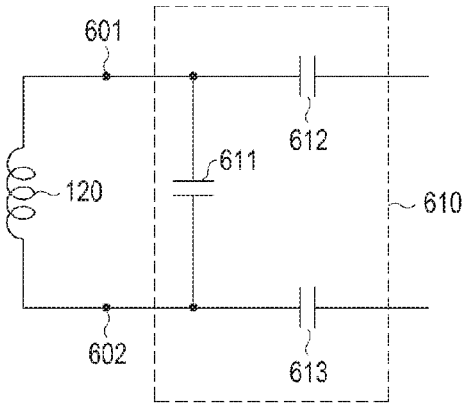
FIGS. 6A and 6B illustrate circuit diagrams according to various embodiments of the present disclosure.
Figure 6B:
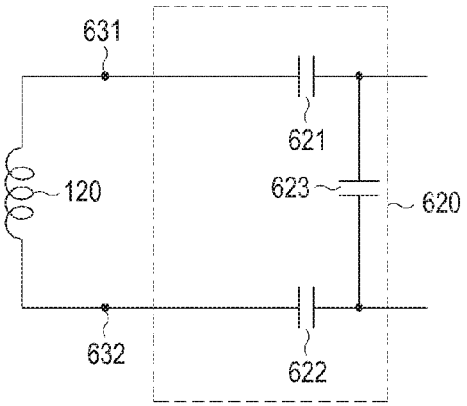

FIGS. 6A and 6B illustrate circuit diagrams according to various embodiments of the present disclosure.

In the embodiment of FIG. 6A, an external inductor 120 and an internal element 610 of a wireless power receiver configured for resonance method is illustrated. The external inductor 120 may include a first connecting unit 601 and a second connecting unit 602. For example, one end of the external inductor 120 may be connected to the first connecting unit 601 and the other end of the external inductor 120 may be connected to the second connecting unit 602.

The internal element 610 may include a first capacitor 611, the first end of which is connected to the first connecting unit 601, and the second end of which is connected to the second connecting unit 602. In addition, the internal element 610 may include a second capacitor 612, the first end of which is connected to the first connecting unit 601 and to the first end of the first capacitor 611. In addition, the internal element 610 may include a third capacitor 613, the first end of which is connected to the second connecting unit 602 and to the second end of the first capacitor 611.

When the external inductor 120 is connected to the wireless power receiver, the first connecting unit 601, the first capacitor 611, and the second capacitor 612 may be connected with each other. When the external inductor 120 is connected to the wireless power receiver, the second connecting unit 602, the first capacitor 611, and the third capacitor 613 may be connected with each other. The external inductor 120 and the internal element 610 may be detachably mechanically coupled to each other where they may be detachable from or attachable to each other.

The external inductor 120, the first capacitor 611, the second capacitor 612, and the third capacitor 613 may form a resonance circuit having the same resonance frequency as the wireless power transmitter from which power will be received. The received power may be transferred to a wireless power processing unit, such as a rectifying unit to convert the power from AC to DC.

In the embodiment of FIG. 6*b*, the external inductor 120 and the internal element 610 of the wireless power receiver are configured for the inductive method. The external inductor 120 may include a first connecting unit 631 and a second connecting unit 632. For example, the first end of the external inductor 120 may be connected to the first connecting unit 631, and the second end of the external inductor 120 may be connected to the second connecting unit 632.

The internal element 620 may include a first capacitor 621, the first end of which is connected to the first connecting unit 631. The internal element 620 may include a second capacitor 622, the first end of which is connected to the second connecting unit 632. The internal element 620 may include a third capacitor 623, the first end of which is connected to the second end of the first capacitor 621, and the second end of which is connected to the second end of the second capacitor 622.

When the external inductor 120 is connected to the wireless power receiver, the first connecting unit 631 and the first capacitor 621 may be connected with each other. When the external inductor 120 is connected to the wireless power receiver, the second connecting unit 632 and the second capacitor 622 may be connected with each other. The external inductor 120 and the internal element 610 may be detachable from or attachable to each other.

The external inductor 120 and an inductor of a wireless power transmitter may inductively couple. Based on the magnetic field generated by the inductor of the wireless power transmitter, current may be induced in the external inductor 120, and so current may flow to a wireless power processing unit, such as a rectifying unit.

Figure 7A:
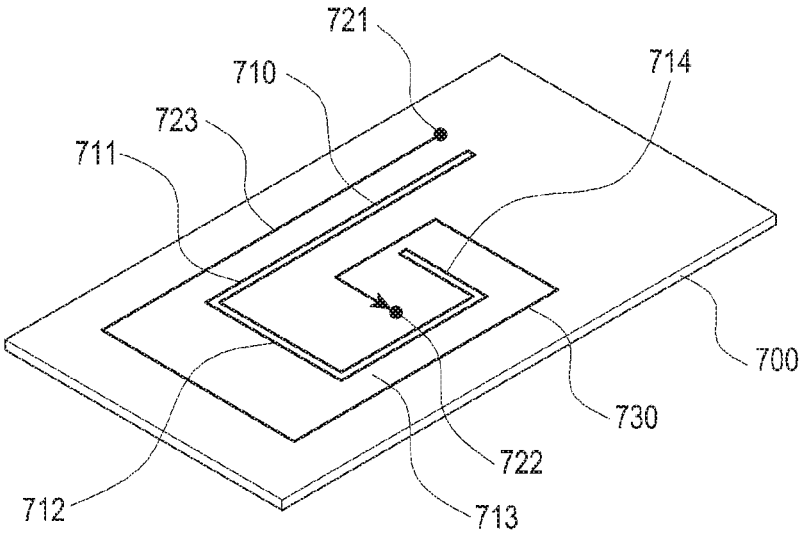
FIG. 7A illustrates a conceptual view of an external inductor according to various embodiments of the present disclosure.

FIG. 7A illustrates a conceptual view of an external inductor according to various embodiments of the present disclosure.

As illustrated in FIG. 7A, a main slit 710 may be formed on an external inductor 700, where the external inductor 700 may include a conductor. The main slit 710 may refer to a cutout portion having a width less than a predetermined value. The main slit 710 may include a first sub-slit 711, a second sub-slit 712, a third sub-slit 713, and a fourth sub-slit 714 where the sub-slits may form the main slit 710. Looking down on FIG. 7A, the first sub-slit 711 is in the left portion of the external inductor 700, the second sub-slit 712 is in the lower portion of the external inductor 700, the third sub-slit 713 is in the right portion of the external inductor 700, and the fourth sub-slit 714 is in the central portion of the external inductor 700 and may point toward the first sub-slit 711 from the third sub-slit 713. In one embodiment, each of the adjacent sub-slits may be orthogonal to each other where they meet.

As described above, the main slit 710 may be formed such that the remaining conductor follows the shape of the main slit 710 in substantially a loop shape. It is assumed that the main slit 710 is of sufficient width such that current cannot flow across any portion of the main slit 710. Accordingly, current may be said to flow from the first point 721 to the second point 722 in the conductor along the main slit 710. As a result, current may flow from the first point 721 to the second point 722 in a path 723 substantially in the form of a loop. Therefore, when a magnetic field encompasses the external inductor 700, an induced current may flow between the first point 721 and the second point 722. According to various embodiments of the present disclosure, the main slit 710 may have various forms such that the remaining conductor has substantially a loop shape.

Although the first point 721 and the second point 722 are mentioned, the disclosure does not limit embodiments to say that the current only flows from the first point 721 to the second point 722, or that current does not flow in other areas of the external inductor 700. Rather, the first point 721 and the second point 722 are only specifically mentioned for ease of explanation. This convention of current flowing from one point of a conductor to another point of the conductor will be followed in this disclosure purely for the sake of convenience, and does not indicate that current does not flow in other parts of a conductor. Additionally, since the external inductor 700 includes a conductor, the external inductor 700 may be partially or entirely made of conductive material.

Figure 7B:
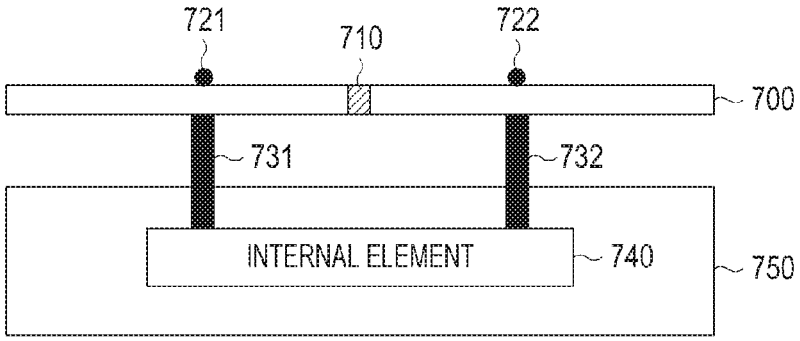
FIGS. 7B to 7G illustrate side views of an external inductor according to various embodiments of the present disclosure.

As illustrated in FIG. 7B, the first connecting unit 731 may connect the external inductor 700 with the wireless power receiver 750 at the first point 721. The second connecting unit 732 may connect the external inductor 700 with the wireless power receiver 750 at the second point 722. In one embodiment, the first connecting unit 731 may connect the first point 721 and the internal element 740 with each other, and the second connecting unit 732 may connect the second point 722 and the internal element 740 with each other. As described above, the external inductor 700 together with the internal element 740 may receive wireless power from a wireless power transmitter. In one embodiment, the external inductor 700 and the internal element 740 may form a resonance circuit, and may receive wireless power from the wireless power transmitter based on the resonance method. In another embodiment, the external inductor 700 may generate an induced current based on the magnetic field from the wireless power transmitter and the induced current may flow to the internal element 740, and accordingly may receive wireless power from the wireless power transmitter based on the inductive method.

Figure 7C:
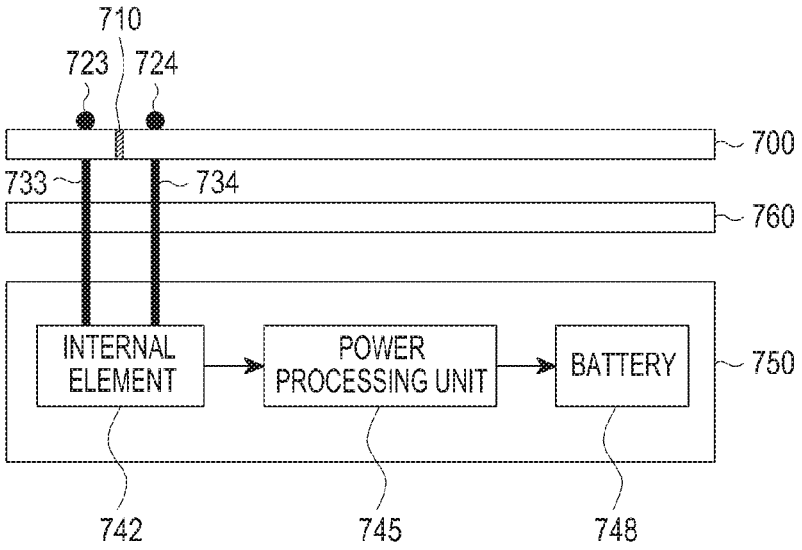

As illustrated in FIG. 7C, the wireless power receiver 750 may further include a power processing unit 745 and a battery 748 in addition to the internal element 742. The power processing unit 745 may include, for example, a rectifying unit and a DC/DC converter unit. The battery 748 may store power rectified and converted to an appropriate voltage by the power processing unit 745. In various embodiments of the present disclosure, an insulation unit 760 may be disposed between the external inductor 700 and the wireless power receiver 750. In one embodiment, the insulation unit 760 may include ferrite material.

Figure 7D:
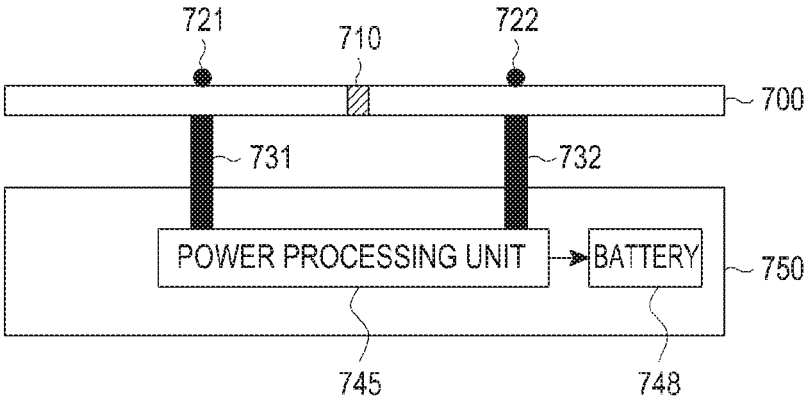

As illustrated in FIG. 7D, according to various embodiments of the present disclosure, the contact units 731 and 732 may be directly connected to the power processing unit 745. The power processing unit 745 may include elements for wireless power charging except an inductor. More specifically, the power processing unit 745 may include a rectifier, a DC/DC converter and/or other elements for wireless power charging according to the inductive method or the resonance method, except for an inductor.

Figure 7E:
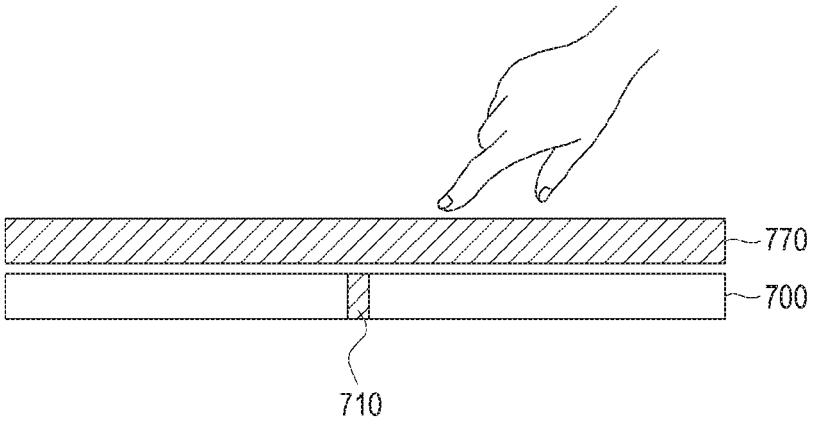
Figure 7F:
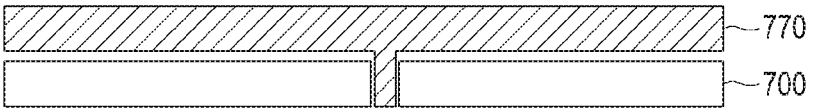
Figure 7G:
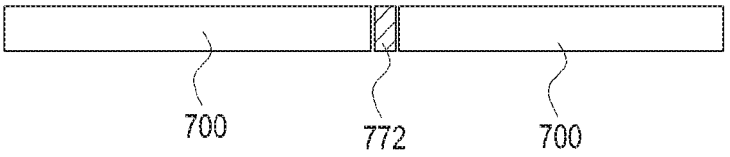

FIGS. 7E to 7G are side views of an external inductor according to various embodiments of the present disclosure.

Referring to FIG. 7E, the insulator 770 may be disposed on at least part of at least one side of the external inductor 700, for example, on top side of the external inductor 700. Herein, "top" is with respect to the external inductor 700 and means opposite direction from the external inductor 700 to a wireless power receiver associated with the external inductor 700. Accordingly, the user may not directly contact the external inductor 700. Also the insulator 770 may provide water proofing function for the parts below it. The insulator 770 may comprise matter that can insulate against direct current flow through the insulator 770 and can allow electromagnetic field or magnetic field to permeate through it. The insulator 770 may comprise, for example, glass or plastic. Referring to FIG. 7F, the insulator 771 may be disposed not only on the top side of the external inductor 700, but also in the slit 710. Referring to FIG. 7G, the insulator 772 may be disposed in the slit 710.

Figure 8:
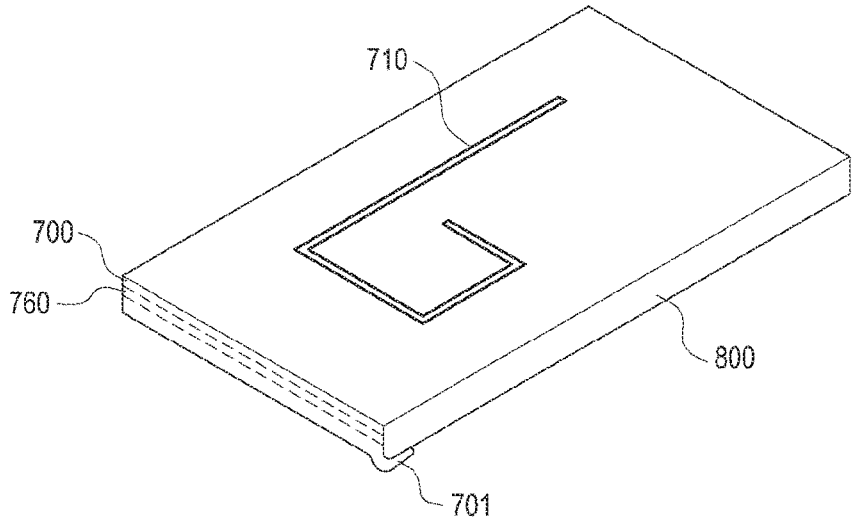
FIG. 8 illustrates a conceptual view of an external inductor coupled to a wireless power receiver according to various embodiments of the present disclosure.

FIG. 8 illustrates a conceptual view of an external inductor coupled to a wireless power receiver according to various embodiments of the present disclosure.

As illustrated in FIG. 8, the external inductor 700 may include a main slit 710. The insulation unit 760 may be disposed below the external inductor 700. In addition, the external inductor 700 may include a fastening unit 701 that may be flexible, which may be used to couple the wireless power receiver 800 to the external inductor 700. According to various embodiments of the present disclosure, the fastening unit 701 may be implemented by an element that may resist flexing. When the wireless power receiver 800 is to be coupled to the external inductor 700, the fastening unit 701 may be pushed out of the way so that the wireless power receiver 800 may be placed below the external inductor 700. When released, the fastening unit may clamp the wireless power receiver 800 to the external inductor 700. As a result, the wireless power receiver 800 and the external inductor 700 may be fastened to each other. When the wireless power receiver 800 and the external inductor are fastened together, as illustrated in FIG. 7C, the first connecting unit and the second connecting unit of the external inductor 700 may also be electrically connected with the wireless power receiver 800.

Figure 9A:
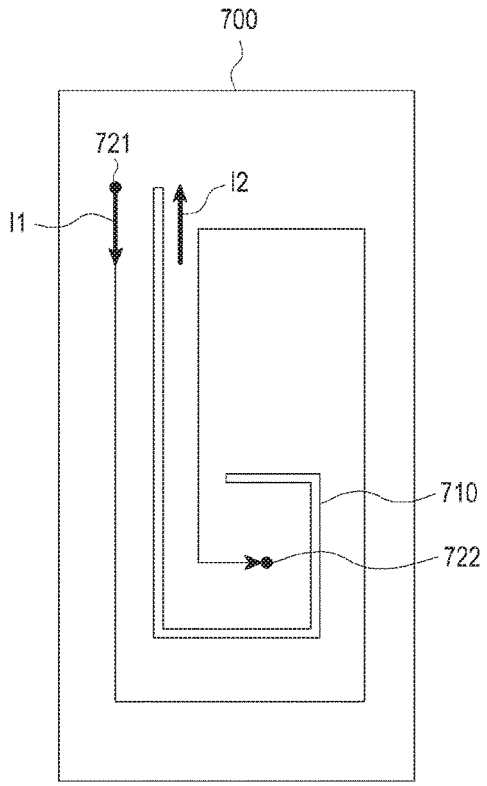
FIGS. 9A and 9B illustrate conceptual views for describing an auxiliary slit according to various embodiments of the present disclosure.
Figure 9B:
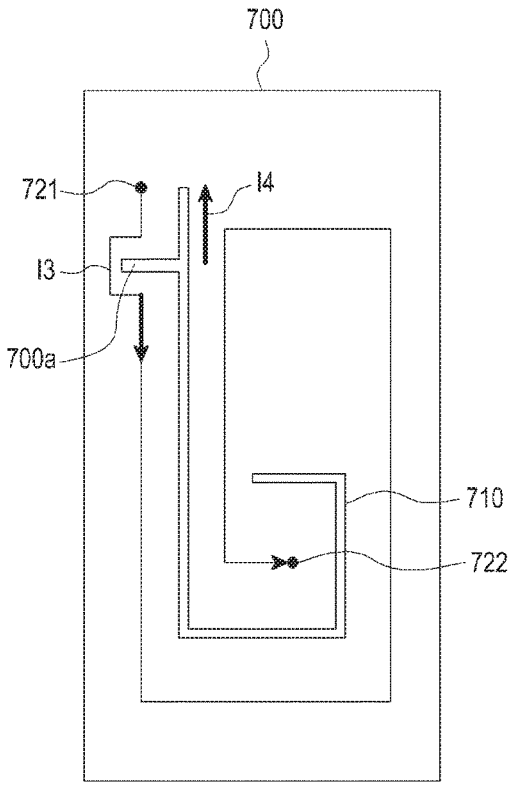

FIGS. 9A and 9B are conceptual views for describing an auxiliary slit according to various embodiments of the present disclosure. First, referring to FIG. 9A, an external inductor 700 may include a main slit 710. As described above, the main slit 710 may be formed such that the remaining conductor of the external inductor 700 has substantially a loop shape. When only the main slit 710 is formed, it is assumed that a first current I1 flows from the first point 721 to the second point 722. However, there may be an image current I2 flowing opposite to the first current I1 in the conductor. The image current I2 is due to a magnetic field generated by the induced current I1 opposing the induced current I1. Accordingly, the magnitude of the current flowing from the first point 721 to the second point 722 may be reduced to I1−I2.

FIG. 9B illustrates an external inductor 700 in which an auxiliary slit 700*a* is formed according to various embodiments of the present disclosure. As illustrated in FIG. 9B, the auxiliary slit 700*a* may be a slit connected to the main slit 710. In various embodiments of the present disclosure, the main slit 710 and the auxiliary slit 700*a* may be orthogonal to each other at their junction.

When the auxiliary slit 700*a* is formed, the current I3 from the first point 721 may be larger than current I1 of FIG. 9A. As path from the first point 721 to the second point 722 increases, the inductance of the conductor formed by the slit increases. Accordingly, the induced current I3 may increase as the inductance increases. Moreover, value of the image current I2 or I4 is proportional to value of the induced current I1 or I3. Since the induced current I3 increases compared to induced current I1, difference I3−I4 also increases compared to difference I1−I2.

FIGS. 10A to 10G illustrate conceptual views for describing a slit pattern according to various embodiments of the present disclosure.

Figure 10A:
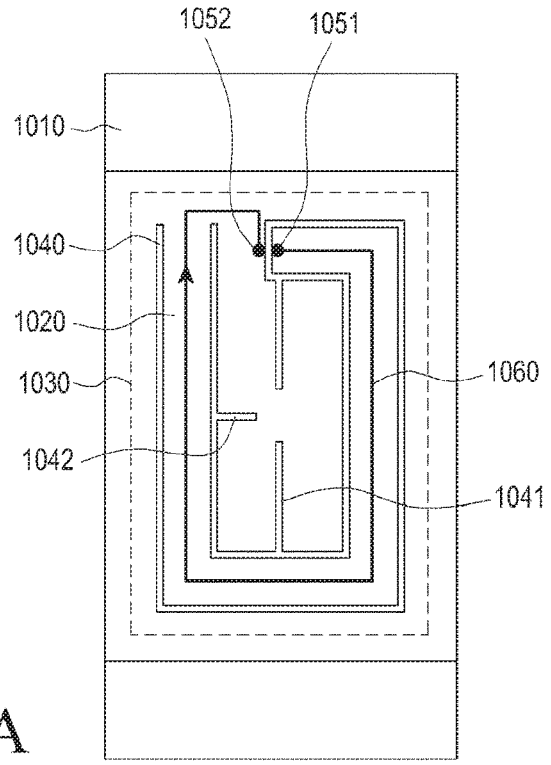
FIGS. 10A to 10G illustrate conceptual views for describing a slit pattern according to various embodiments of the present disclosure.

Referring to FIG. 10A, an external inductor 1020 may be disposed on a wireless power receiver 1010, and an insulation unit 1030 may be between the wireless power receiver 1010 and the external inductor 1020. A main slit 1040 may be formed on the external inductor 1020, and auxiliary slits 1041 and 1402 may be additionally formed. When a magnetic field enters the external inductor 1020, an induced current 1060 may flow from the first point 1051 to the second point 1052.

Figure 10B:
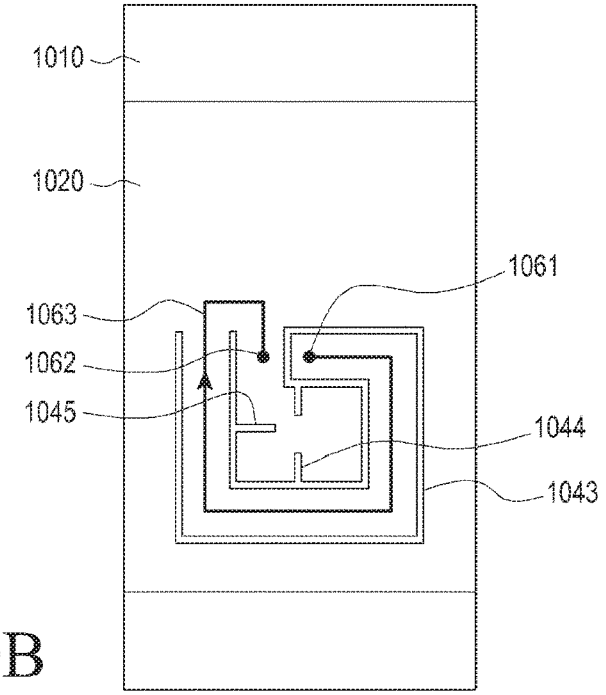
Figure 10C:
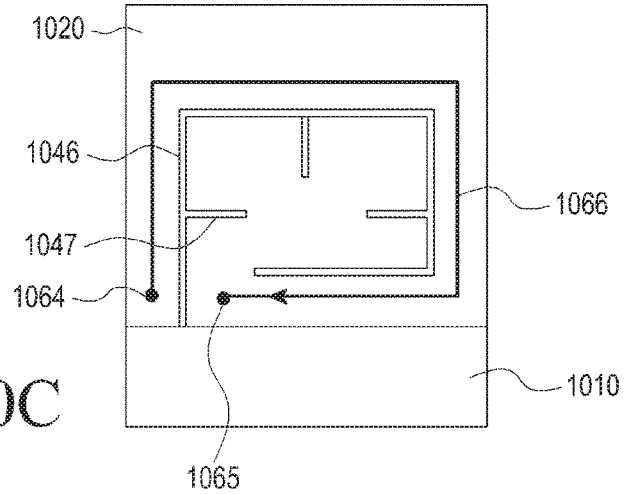
Figure 10D:
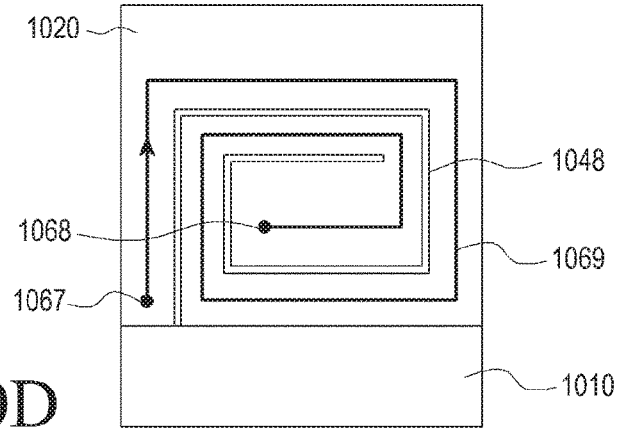
Figure 10E:
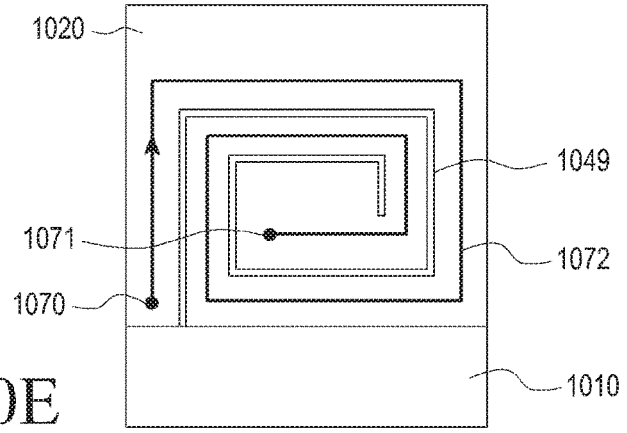
Figure 10F:
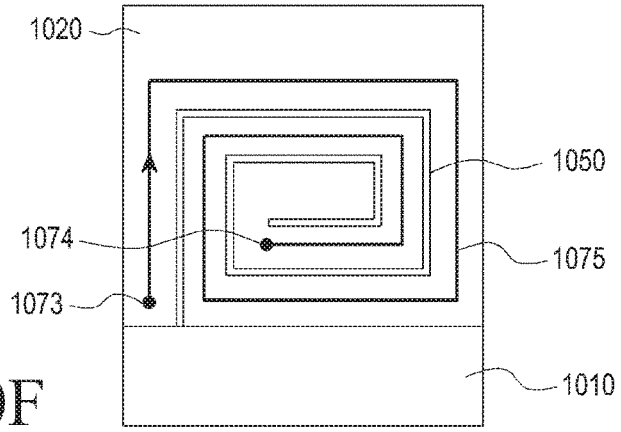
Figure 10G:
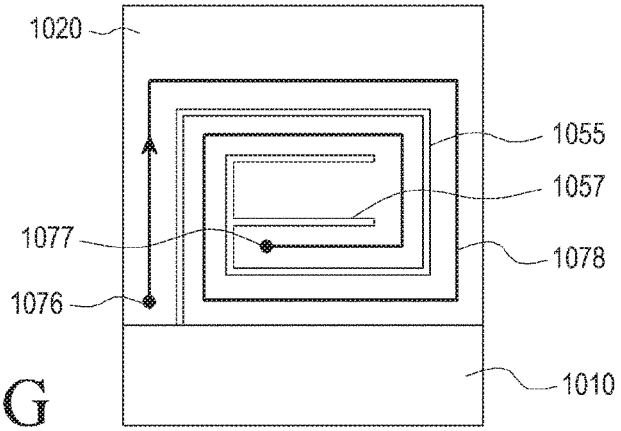

Referring to FIG. 10B, the main slit 1043 and the auxiliary slits 1044 and 1045 may be formed in a smaller portion of the external inductor 1020 as compared to the pattern of FIG. 10A. When a magnetic field enters the external inductor 1020, an induced current 1063 may flow from the first point 1061 to the second point 1062.

As illustrated in FIGS. 10C to 10G, main slits 1046, 1048, 1049, 1050, and 1055 may be formed in various shapes and sizes, and auxiliary slits 1047 and 1057 may also be formed in various shapes and sizes. In addition, the positions of points 1064, 1065, 1067, 1068, 1070, 1071, 1073, 1074, 1076, and 1077 may be variously determined so as to generate various induced currents 1066, 1069, 1072, 1075, and 1078. That is, positions of points may be determined according to structure of the slit.

Figure 11A:
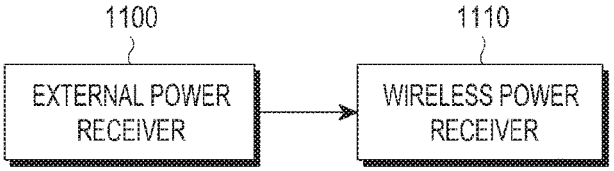
FIGS. 11A and 11B illustrate block diagrams of a power receiver and a wireless power receiver according to various embodiments of the present disclosure.
Figure 11B:
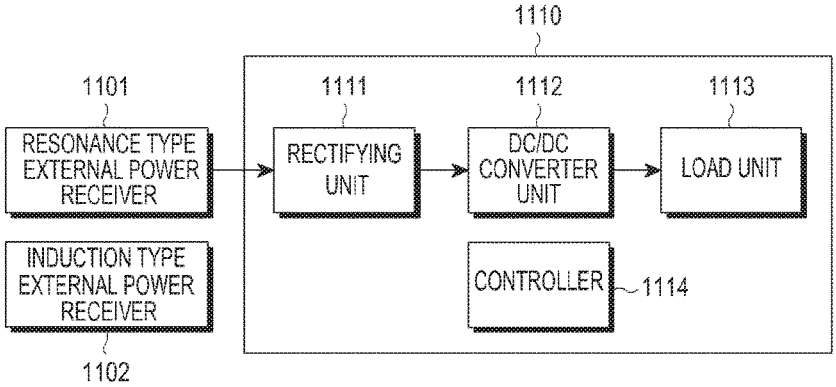

FIGS. 11A and 11B illustrate block diagrams of an external power receiver and a wireless power receiver according to various embodiments of the present disclosure.

First, referring to FIG. 11A, according to various embodiments of the present disclosure, the external power receiver 1100 may be connected to the wireless power receiver 1110. In various embodiments of the present disclosure, the external power receiver 1100 and the wireless power receiver 1110 may be fabricated as separate pieces of hardware. More specifically, the external power receiver 1100 may be detachable from or attachable to the wireless power receiver 1110. For example, the external power receiver 1100 may include a fastening unit that may be used to fasten to the wireless power receiver 1110, and the wireless power receiver 1110 may include a counterpart fastening unit corresponding to the fastening unit of the external power receiver 1100. When the fastening unit of the external power receiver 1100 and the counterpart fastening unit of the wireless power receiver 1110 are coupled to each other, the external power receiver 1100 and the wireless power receiver 1110 may be fastened to each other. In addition, when the fastening unit of the external power receiver 1100 and the counterpart fastening unit of the wireless power receiver 1110 are unfastened, the external power receiver 1100 and the wireless power receiver 1110 may be separated from each other.

The external power receiver 1100 may be electrically connected to the wireless power receiver 1110. The wireless power receiver 1110 may include, for example, at least one conductor that may be connected with the external power receiver 1100. In one embodiment, the wireless power receiver 1110 may include a first conductor and a second conductor, and the first conductor may be connected to the first point of the external power receiver 1100. In addition, the second conductor may be connected to the second point of the external power receiver 1100.

The external power receiver 1100 may receive wireless power from a wireless power transmitter (not illustrated). In one embodiment, the external power receiver 1100 may form a resonance circuit. In one embodiment, the external power receiver 1100 may receive wireless power based on the resonance method, and may transmit wireless power to the wireless power receiver 1110. The wireless power receiver 1110 may process the power from the external power receiver 1100 by, for example, rectifying and converting to DC power of a desired voltage.

In another embodiment, the external power receiver 1100 may receive wireless power from a wireless power transmitter (not illustrated) based on the inductive method. The wireless power transmitter (not illustrated) may include an inductor. The inductor of the wireless power transmitter (not illustrated) may inductively couple with the external power receiver 1100. The inductor of the wireless power transmitter (not illustrated) may generate a magnetic field, and the external power receiver 1100 may generate induced current based on the magnetic field from the wireless power transmitter (not illustrated). The received wireless power associated with the induced current may be processed by the wireless power receiver 1110. For example, the wireless power receiver 1110 may rectify and/or convert the wireless power to a desired DC voltage. The wireless power receiver 1110 may store or output the processed wireless power.

As described above, the external power receiver 1100 may receive wireless power from the wireless power transmitter (not illustrated), and may transfer the wireless power to the wireless power receiver 1110.

FIG. 11B illustrates an external power receiver according to various embodiments of the present disclosure. As illustrated in FIG. 11B, one of a resonance type external power receiver 1101 and an induction type external power receiver 1102 may be connected to a rectifying unit 1111. For example, in an environment where a resonance type wireless power transmitter is disposed, a resonance type external power receiver 1101 may be connected to the wireless power receiver 1110. Or, in an environment where an induction type wireless power transmitter is disposed, an induction type external power receiver 1102 may be connected to the wireless power receiver 1110. Accordingly, it is possible to make the wireless power receiver 1110 chargeable in a wireless manner that accommodates various wireless charging environments. The wireless power receiver 1110 may include a rectifying unit 1111, a DC/DC converter unit 1112, a load unit 1113, and a controller 1114. Each of the above-mentioned elements was described in detail above with reference to FIG. 5, therefore, descriptions of those elements will not be repeated.

Figure 11C:
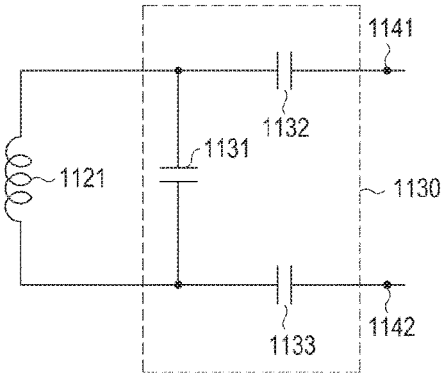
FIG. 11C illustrates a circuit diagram for a resonance type power receiver according to various embodiments of the present disclosure.

FIG. 11C illustrates a circuit diagram of a resonance type external power receiver according to various embodiments of the present disclosure. As illustrated in FIG. 11C, the resonance type external power receiver may include an inductor 1121 and at least one capacitor 1130. According to various embodiments of the present disclosure, the inductor 1121 may be implemented by a conductor that includes a main slit, or a main slit and an auxiliary slit, as illustrated in FIGS. 7A to 10G.

For the resonance type external power receiver, the at least one capacitor 1130 may comprise the first capacitor 1131, the second capacitor 1132, and the third capacitor 1133. The first end of the first capacitor 1131 is connected to the first end of the inductor 1121, and the second end of the first capacitor 1131 is connected to the second end of the inductor 1121. The resonance type external power receiver may include a second capacitor 1132, of which the first end is connected to the first end of the inductor 1121 and to the first end of the first capacitor 1131. The resonance type external power receiver may include a third capacitor 1133, of which the first end is connected to the second end of the inductor 1121 and to the second end of the first capacitor 1131. The second end of the second capacitor 1132 may be connected to the first connecting unit 1141, and the second end of the third capacitor 1133 may be connected to the second connecting unit 1142. The first connecting unit 1141 and the second connecting unit 1142 may be connected to the wireless power receiver.

Figure 11D:
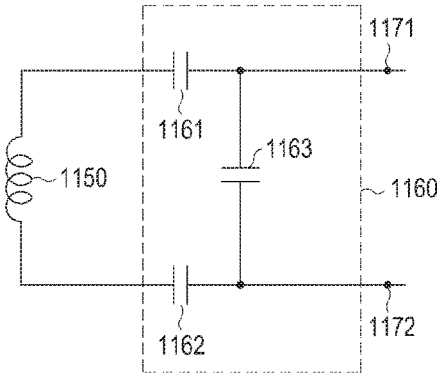
FIG. 11D illustrates a circuit diagram for an induction type power receiver according to various embodiments of the present disclosure.

FIG. 11D illustrates a circuit diagram of an induction type external power receiver according to various embodiments of the present disclosure. As illustrated in FIG. 11D, the induction type external power receiver may include an inductor 1150 and at least one capacitor 1160. According to various embodiments of the present disclosure, the inductor 1150 may be implemented by a conductor that includes a main slit, or a main slit and an auxiliary slit, as illustrated in FIGS. 7A to 10G.

For the induction type external power receiver the at least one capacitor 1160 may comprise the first capacitor 1161, the second capacitor 1162, and the third capacitor 1163. The first end of the first capacitor 1161 is connected to the first end of the inductor 1150. The first end of the second capacitor 1162 is connected to the second end of the inductor 1150. The first end of the third capacitor 1163 is connected to the second end of the first capacitor 1161, and the second end of third capacitor 1163 is connected to the second end of the second capacitor 1162. The second end of the first capacitor 1161 and the first end of the third capacitor 1163 may be connected to the first connecting unit 1171. The second end of the second capacitor 1162 and the second end of the third capacitor 1163 may be connected to the second connecting unit 1172. The first connecting unit 1171 and the second connecting unit 1172 may be connected to the wireless power receiver.

Figure 12:
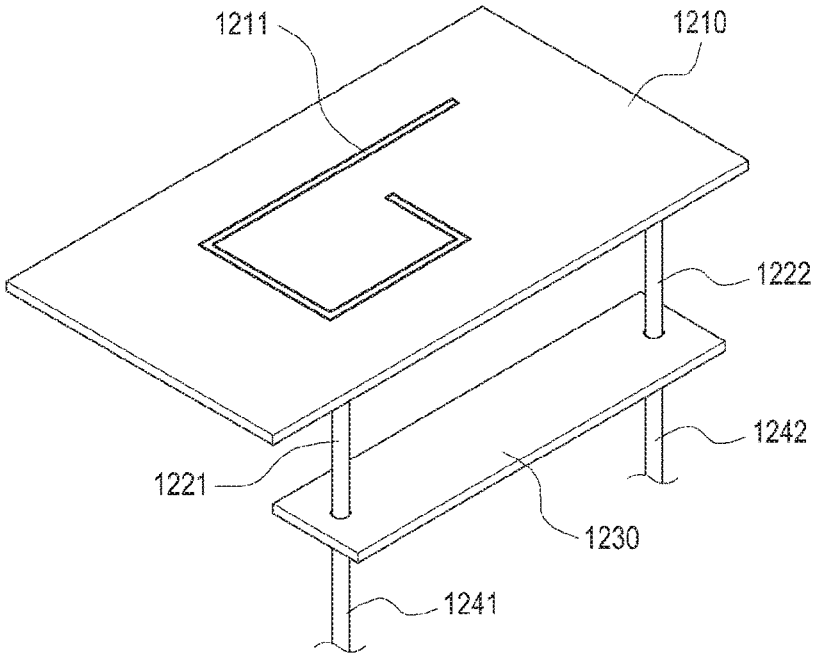
FIG. 12 illustrates a conceptual view of an external power receiver according to various embodiments of the present disclosure.

FIG. 12 illustrates a conceptual view of an external power receiver according to various embodiments of the present disclosure. As illustrated in FIG. 12, the external power receiver may include a conductor 1210 on which a main slit 1211 is formed. The conductor 1210 may be connected to the at least one capacitor 1230 by a first conductor 1221 and a second conductor 1222. The at least one capacitor 1230 may be connected to a wireless power receiver through a third conductor 1241 and a fourth conductor 1242.

Figure 13A:
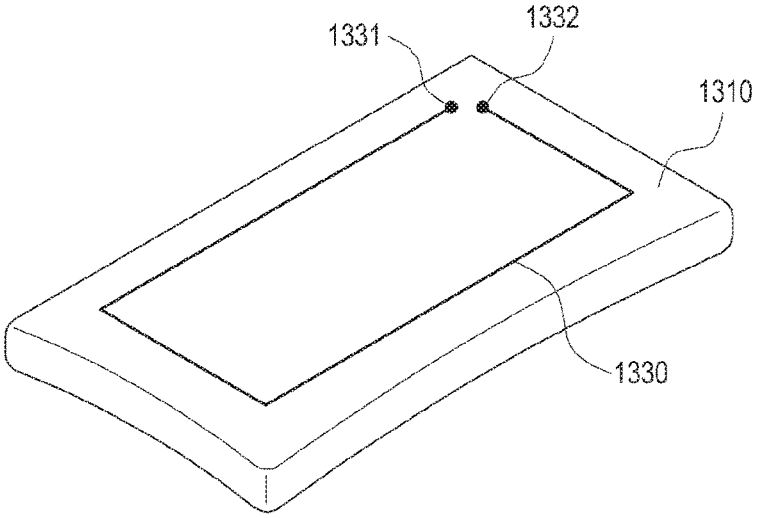
FIG. 13A illustrates a conceptual view of an external inductor according to various embodiments of the present disclosure.

FIG. 13A illustrates a conceptual view of an external inductor according to various embodiments of the present disclosure. As illustrated in FIG. 13A, the external inductor may include the wireless power receiver case 1310, the inductor 1330, the first connecting unit 1331, and the second connecting unit 1332. As illustrated in FIG. 13A, according to various embodiments of the present disclosure, the external inductor may include the inductor 1330 in the form of a loop. Accordingly, it should be understood by a person of ordinary skill in the art that the wireless power receiver case 1310 is not conductive except for the inductor 1330. A wireless power receiver may be fastened to the wireless power receiver case 1310. Meanwhile, the external inductor and the wireless power receiver may be electrically connected with each other via the first connecting unit 1331 and the second connecting unit 1332. While FIG. 13A is described as having the first connecting unit 1331 and the second connecting unit 1332, it may also be described as having a first point and a second point that may then connect to a first connecting unit and a second connecting unit.

Figure 13B:
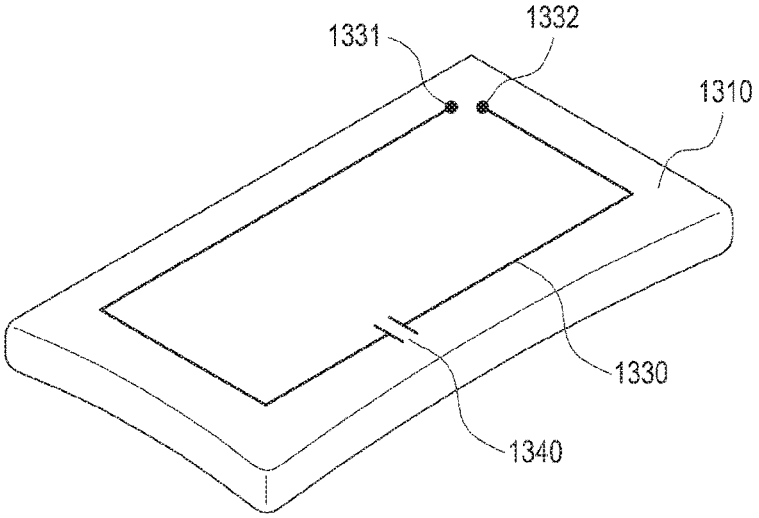
FIG. 13B illustrates a conceptual view of an external power receiver according to various embodiments of the present disclosure.

FIG. 13B illustrates a conceptual view of an external power receiver according to various embodiments of the present disclosure. As illustrated in FIG. 13B, the external power receiver may include the wireless power receiver case 1310, the inductor 1330, at least one capacitor 1340, the first connecting unit 1331, and the second connecting unit 1332. As illustrated in FIG. 13B, according to various embodiments, the external power receiver may include an inductor 1330 in the form of a loop. Accordingly, it should be understood by a person of ordinary skill in the art that the power receiver case 1310 is not conductive except for the inductor 1330. A wireless power receiver may be fastened to the wireless power receiver case 1310. The external power receiver and the wireless power receiver may be electrically connected with each other through the first connecting unit 1331 and the second connecting unit 1332. In addition, the inductor 1330 and the at least one capacitor 1340 may be implemented by various types of circuits as illustrated in FIG. 11C or 11D. Similarly as explained for FIG. 13A, FIG. 13B may be described as having a first point and a second point that may then connect to a first connecting unit and a second connecting unit Each of the above-described elements of various embodiments of the disclosure may be configured as one or more components, and the names of corresponding constituent elements may vary depending on a kind of electronic devices. In various embodiments, the electronic device may include at least one of the above-described elements. Some of the above-described elements may be omitted from the electronic device, or the electronic device may further include additional elements. Further, some of the components of the electronic device according to the various embodiments of the present disclosure may be combined to form a single entity, and thus, may equivalently execute functions of the corresponding elements prior to the combination.

The term "module" as used herein may mean, for example, a unit including one of hardware, software, and firmware or a combination of two or more of them. The "module" may be interchangeably used with, for example, the term "unit," "logic," "logical block," "component," or "circuit." The "module" may be the smallest unit of an integrated component or a part thereof. The "module" may be the smallest unit that performs one or more functions or a part thereof. The "module" may be mechanically or electronically implemented. For example, the "module" according to the present disclosure may include at least one of an Application-Specific Integrated Circuit (ASIC) chip, a Field-Programmable Gate Arrays (FPGA), and a programmable-logic device for performing operations which has been known or are to be developed hereinafter.

The programming module according to the present disclosure may include one or more of the aforementioned components or may further include other additional components, or some of the aforementioned components may be omitted. Operations executed by a module, a programming module, or other component elements according to various embodiments of the present disclosure may be executed sequentially, in parallel, repeatedly, or in a heuristic manner. Further, some operations may be executed according to another order or may be omitted, or other operations may be added.

Various embodiments disclosed herein are provided merely to easily describe technical details of the present disclosure and to help the understanding of the present disclosure, and are not intended to limit the scope of the present disclosure. Therefore, it should be understood that all modifications and changes or modified and changed forms based on the technical idea of the present disclosure fall within the scope of the present disclosure.

What is claimed is:

1. A wireless power receiver, comprising:

a conductor including a slit;

a power processing unit configured to process received wireless power;

a first connecting unit configured to connect a first point of the conductor to the power processing unit; and a second connecting unit configured to connect a second point of the conductor to the power processing unit, wherein positions of the first connecting unit and the second connecting unit are determined according to a structure of the slit.

2. The wireless power receiver of claim 1, further comprising an insulator disposed at least on a portion of the conductor and below the conductor.

3. The wireless power receiver of claim 1, further comprising an insulator disposed in the slit.

4. The wireless power receiver of claim 2, wherein the insulator comprises at least one of glass and plastic.

5. The wireless power receiver of claim 1, wherein the conductor is at least a part of a metal case, and wherein the metal case is at least a part of a rear cover of the wireless power receiver.

6. The wireless power receiver of claim 1, wherein the conductor is detachable from the wireless power receiver.

7. The wireless power receiver of claim 1, wherein the conductor is configured with the power processing unit to generate induced current at a specific resonance frequency to receive the wireless power based on resonance method.

8. The wireless power receiver of claim 7, wherein the power processing unit includes at least one capacitor, and the conductor and the at least one capacitor form a resonance circuit having the specific resonance frequency.

9. The wireless power receiver of claim 7, wherein the induced current flows from the first point to the second point.

10. The wireless power receiver of claim 7, wherein the power processing unit includes:

a first capacitor, wherein a first end of the first capacitor is connected to the first connecting unit and a second end of the first capacitor is connected to the second connecting unit;

a second capacitor, wherein a first end of the second capacitor is connected to the first connecting unit and to the first end of the first capacitor; and a third capacitor, wherein a first end of third capacitor is connected to the second connecting unit and to the second end of the first capacitor.

11. The wireless power receiver of claim 1, wherein the conductor is configured with the power processing unit to receive wireless power based on inductive method.

12. The wireless power receiver of claim 11, wherein the conductor is configured to inductively couple with an inductor of a wireless power transmitter to generate an induced current in the conductor.

13. The wireless power receiver of claim 12, wherein the induced current flows from the first point to the second point.

14. The wireless power receiver of claim 11, wherein the power processing unit includes:

a first capacitor, wherein a first end of the first capacitor is connected to the first connecting unit;

a second capacitor, wherein a first end of the second capacitor is connected to the second connecting unit; and a third capacitor, wherein a first end of the third capacitor is connected to a second end of the first capacitor, and a second end of the third capacitor is connected to a second end of the second capacitor.

15. The wireless power receiver of claim 1, wherein the conductor comprises a fastening unit configured to physically fasten an external inductor to the wireless power receiver.

16. The wireless power receiver of claim 1, wherein the slit comprises at least one slit and at least one auxiliary slit that is connected to the at least one slit.

17. The wireless power receiver of claim 16, wherein the at least one auxiliary slit is perpendicular to the at least one slit at a junction of the at least one slit and the at least one auxiliary slit.

18. The wireless power receiver of claim 1, wherein the slit in the conductor has a shape that causes a remaining portion of the conductor to be substantially in shape of a loop.

* * * * *